US007421222B2

(12) United States Patent
Kubo et al.

(10) Patent No.: US 7,421,222 B2
(45) Date of Patent: Sep. 2, 2008

(54) ELECTROPHOTOGRAPHIC DEVICE WITH CONTAMINANT-RESISTANT PHOTOCONDUCTOR AND CHARGER

(75) Inventors: Tatsuya Kubo, Hitachinaka (JP); Akio Tsujita, Hitachinaka (JP); Yukio Otome, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 303 days.

(21) Appl. No.: 11/038,528

(22) Filed: Jan. 21, 2005

(65) Prior Publication Data

US 2005/0162136 A1 Jul. 28, 2005

(30) Foreign Application Priority Data

Jan. 22, 2004 (JP) ..... P2004-013858

(51) Int. Cl.
*G03G 15/02* (2006.01)

(52) U.S. Cl. ..... 399/50; 399/100; 399/173

(58) Field of Classification Search ..... 399/173, 399/170, 168, 50, 172, 92, 93, 100
See application file for complete search history.

(56) References Cited

U.S. PATENT DOCUMENTS 3,862,420 A * 1/1975 Banks et al.
5,781,829 A * 7/1998 Wong et al. ..... 399/170
6,025,594 A * 2/2000 Bryce et al. ..... 399/170

FOREIGN PATENT DOCUMENTS

JP 63-15272 1/1988

* cited by examiner

*Primary Examiner*—David M. Gray
*Assistant Examiner*—Laura K Roth
(74) *Attorney, Agent, or Firm*—Whitham Curtis Christofferson & Cook, P.C.

(57) ABSTRACT

In a charging device having saw-tooth electrodes for generating corona discharges, an amount of dust, toner, or paper dust attached to the tip end portions of saw-tooth electrodes is reduced. First to third pairs of saw-tooth electrode plates are disposed in a side-by-side fashion along the periphery of a photosensitive drum in which the first pair is disposed at an upstream side with respect to a direction in which the photosensitive drum rotates, the third pair at a downstream side, and the second pair at a central portion between the remaining two. A current flowing per a unit length of the second pair is set to 1.3 to 3 times as much as a current flowing per a unit length of each of the first and third pairs. The currents flowing per a unit length of the first and third pairs are set to be equal to each other.

17 Claims, 4 Drawing Sheets

ELECTROPHOTOGRAPHIC DEVICE WITH CONTAMINANT-RESISTANT PHOTOCONDUCTOR AND CHARGER

BACKGROUND OF THE INVENTION

1. Field of the Invention

The present invention relates to an electrophotographic image forming device such as copying machine, printer, or facsimile machine. More particularly, the invention relates to a charging device for uniformly charging a photoconductor using a corona discharge.

2. Description of the Related Art

Electrophotographic technology using dry toner is applied to various kinds of image forming devices such as copying machine, printer or facsimile machine due to inexpensive page cost.

FIG. 1 shows a general structure of an electrophotographic image forming device 100. The image forming device 100 includes a photoconductor 2 that is of a drum-shaped and is rotatably supported. A charging device 1, an exposing device 3, a developing device 4, a transfer device 5, and a cleaning device 6 are disposed along the periphery of the photoconductor 2. The charging device 1 uniformly charges the peripheral surface of the photoconductor 2 to negative polarity. The exposing device 3 irradiates light modulated in accordance with image data onto the peripheral surface of the photoconductor 2, thereby forming an electrostatic latent image. The developing device 4 supplies toner to the peripheral surface of the photoconductor 2 to develop the electrostatic latent image. A visible toner image is thus formed on the photoconductor 2, which is then transferred onto a recording medium 7, such as paper, by the transfer device 5. The cleaning device 6 cleans residual toner remaining on the photoconductor 2. The toner image transferred onto the recording medium 7 is conveyed to a fixing device 8 where the toner image is thermally fixed.

For the structural simplicity, a corotron or a scorotron has been used in the charging device 1. The corotron is configured from corona electrodes for generating corona discharges, and a U-shaped shield case for stabilizing the corona discharge. Application of a high voltage across the corona electrodes generates the corona discharge. The peripheral surface of the photoconductor 2 is electrostatically charged with ions generated when the corona discharge has occurred. The scorotron is similar in structure to the corotron but is additionally provided with a grid. The scorotron is disposed so that the grid is interposed between the photoconductor 2 and the corona electrodes. The grid serves to uniformly charge the peripheral surface of the photoconductor 2. In the absence of the grid, the peripheral surface of the photoconductor 2 tends to be non-uniformly charged because the corona discharge of negative polarity is not stable.

FIG. 2 shows a conventional charging device 1. The charging device 1 is disposed above the peripheral surface of the photoconductor 2 in confronting relation therewith. The charging device 1 includes a shield case 12, a partitioning plate 14, wire electrodes 15, and the grid 13.

The wire electrodes 15 are formed from a tungsten wire having a diameter in a range from 50 to 100 μm, and the surface of the tungsten wire is plated with gold to a thickness of several microns. Application of a high voltage, e.g., +/−5 kV, across the wire electrodes 15 results in generation of corona discharges. The photoconductor 2 is charged with ions generated resulting from the corona discharges.

However, corona discharges that generate negative polarity ions produce a great deal of ozone, which degrades electrical characteristics of the photoconductor 2 and also exerts bad influence upon living bodies. An amount of ozone produced by a tandem type color image forming device increases much more than that generated by a monochromatic image forming device, because the color image forming device includes a plurality of image forming unit for each color toner. Accordingly, an enhanced ozone discharging mechanism is required for the color image forming device. This, however, invites increase of cost and production of larger noises In order to solve the above-described problems, Japanese Patent Application Publication No. 63-15272 proposes a charging device in which a saw-tooth shaped electrode is used in place of the wire electrode. The charging device with the saw-tooth shaped electrode decreases the amount of ozone to about one fourth (¼) as compared with the charging device using the wire electrode.

However, the corona discharges generated at the tip end portions of the saw-tooth electrodes attract foreign materials, such as dust, toner, or paper dust floating in the air. Once the foreign materials are adhered to the tip end portion of the saw-tooth electrode, the corona discharge tends to be unstable, causing the image to degrade. To stabilize the generation of corona discharges, the voltage applied to the saw-tooth shaped electrode needs to be increased. However, if the voltage applied to the saw-tooth shaped electrode becomes too high, the corona discharge proceeds to a spark discharge, and thus the photoconductor is damaged.

These problems can be solved if the saw-tooth electrode is perfectly cleaned. However, due to the sharpness of the tip end portion of the saw-tooth electrode, the cleaning member is easily damaged and so the cleaning effect is lowered.

SUMMARY OF THE INVENTION

In view of the foregoing, the present invention has been made to solve the above-described problems. Accordingly, it is an object of the invention to provide a charging device including a saw-tooth electrode plate, wherein adhesion of foreign materials onto the electrode plate is reduced.

In the invention, the current set to flow in the sawtooth electrodes at the upstream and the downstream side is smaller than the current set to flow in the center saw-tooth electrode. This construction reduces the corona discharge at the saw-tooth electrodes at the upstream and the downstream side, reduces the electric field, and reduces the force to collect dust and toner in the air. This construction also reduces the force to collect paper dust, thus, the amount of paper dust attached to the tooth edge of the saw-tooth electrodes can be reduced. Accordingly, it is possible to lengthen a maintenance cycle for cleaning out the saw-tooth electrodes.

To achieve the above and other objects, there is provided, according to one aspect of the invention, a charging device that includes a first saw-tooth electrode section, a second saw-tooth electrode section, a third saw-tooth electrode section. The first saw-tooth electrode section includes a pair of electrode plates each formed with at least one saw-tooth shaped electrode that generates corona discharges for charging the photoconductor. The second and third saw-tooth electrode sections are configured in the same fashion as the first saw-tooth electrode section. The first, second, and third saw-tooth electrode sections are disposed along the surface of the photoconductor in such a manner that the first saw-tooth electrode section is disposed at an upstream side of the second saw-tooth electrode section with respect to a direction in which the photoconductor rotates, the third saw-tooth electrode section is disposed at a downstream side of the second saw-tooth electrode section with respect to the photoconductor rotational direction, and the second saw-tooth electrode section is interposed between the first and third saw-tooth electrode sections. In the invention, current set to flow in a unit length of each of the pair of electrode plates in the second saw-tooth electrode section is 1.3 to 3 times as much as current set to flow in a unit length of each of the pair of electrode plate in the first and third saw-tooth electrode sections.

It is desirable that the current set to flow in the unit length of each of the pair of electrode plates in the first saw-tooth electrode section is equal to the current set to flow in the unit length of each of the pair of electrode plates in the third saw-tooth electrode section.

It is further desirable that a filter be additionally provided in order to prevent foreign materials contained in air from entering into a space where each of the first, second, and third saw-tooth electrode sections is disposed.

According to another aspect of the invention, there is provided an image forming device using the above-described charging device. The image forming device includes in addition to the charging device a photoconductor, an exposing device, a developing device, and a transfer device. The charging device charges the surface of the photoconductor. The exposing device exposes the photoconductor to light in accordance with image data to form a latent image on the surface of the photoconductor. The developing device develops the latent image and forms a visible toner image on the photoconductor. The transfer device transfers the visible toner image onto a recording medium.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
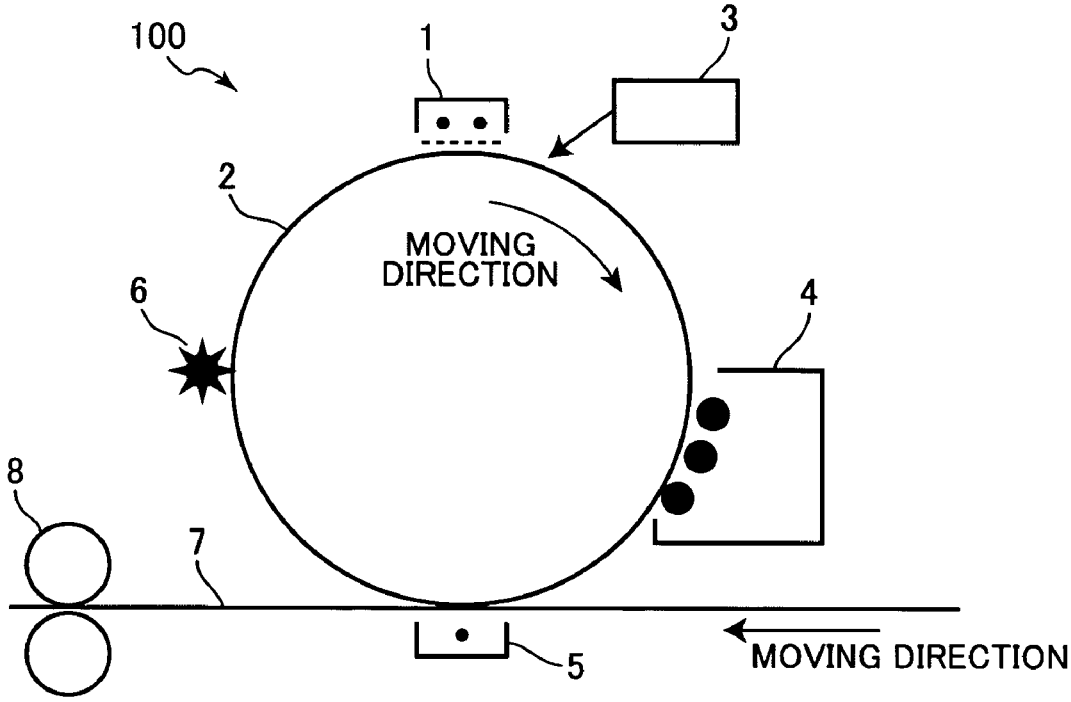
FIG.1 PRIOR ART
FIG. 1 is a schematic diagram showing a conventional image forming device.
Figure 2:
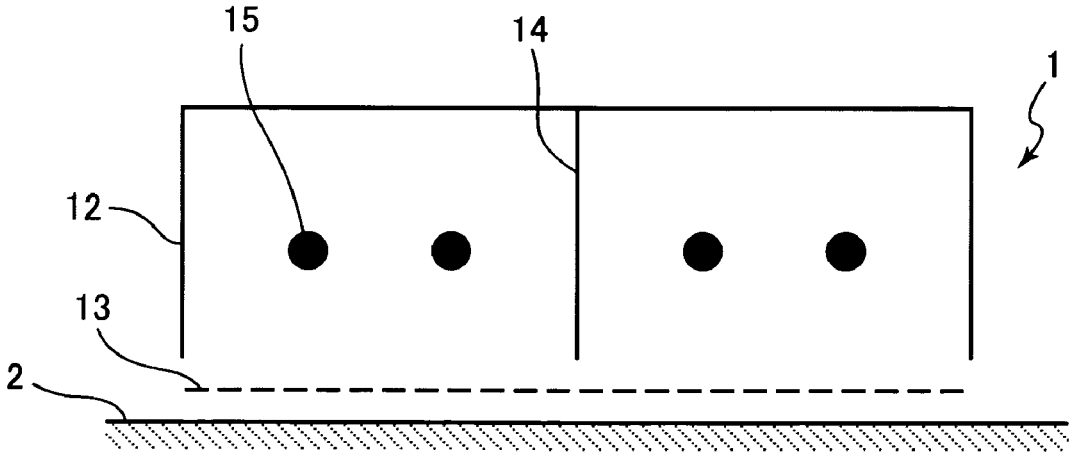
FIG.2 PRIOR ART
FIG. 2 is a schematic diagram showing a conventional charging device.
Figure 3:
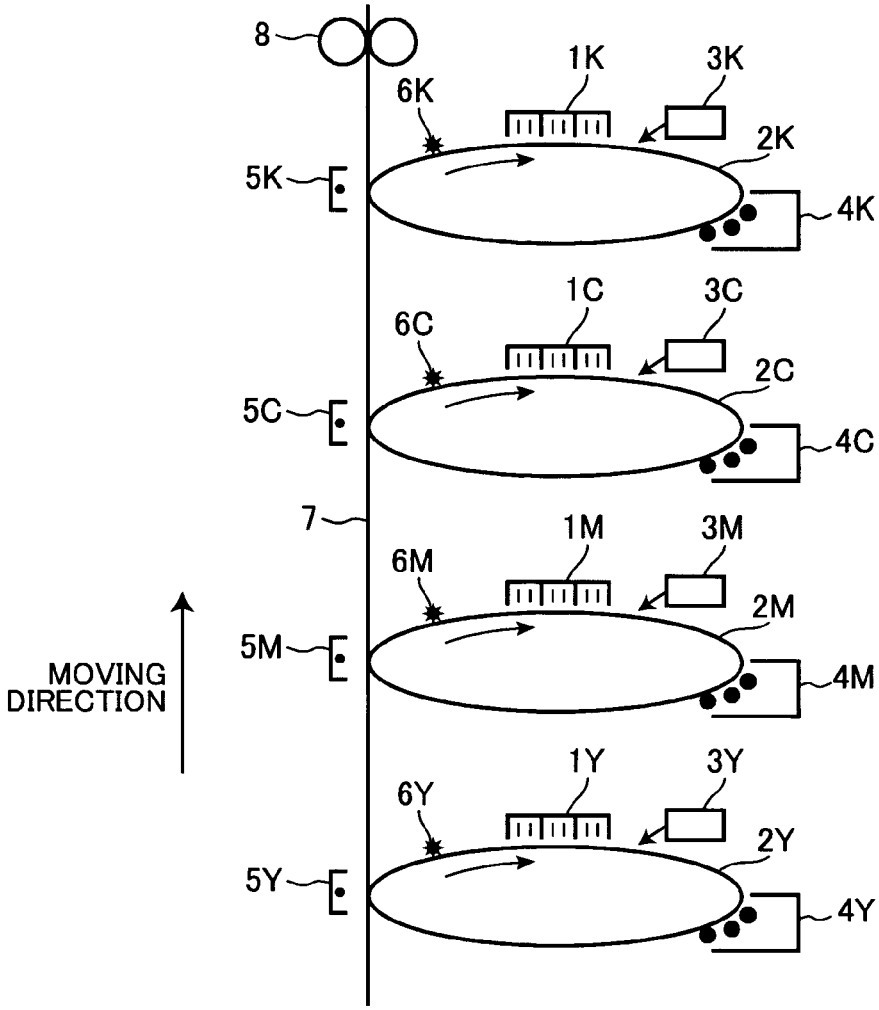
FIG. 3 is a schematic diagram showing an image forming device using a charging device in accordance with a first embodiment of the invention.

A charging device according to a first embodiment of the invention will be described with reference to FIGS. 3 and 4. FIG. 3 is a schematic diagram showing a tandem type full-color image forming device.

The tandem type image forming device includes yellow (Y), magenta (M), cyan (C), and black (K) toner image forming units. These image forming units are disposed in the stated order in a direction in which a recording medium is moved. Because these four image forming units have the same structure, the following description will be focused to the image forming unit using black toner. The corresponding or same components in the four image forming units are designated by the same reference numerals but distinguished by reference characters K, C, M and Y added at the end of the reference numerals.

The black toner image forming unit includes a drum-shaped photoconductor 2K of a laminated structure having a surface layer made from an organic material. The photoconductor 2K is rotatable about an axis at a peripheral speed of, for example, 90 cm/sec. With a charging device 1K according to the embodiment of the invention, the photoconductor 2K is uniformly charged to a negative voltage within a range, for example, from −450 V to −850V.

The black toner image forming unit further includes an exposing device 3K. The exposing device 3K is configured from a plurality of LEDs that is selectively lit based on image data to form an electrostatic latent image on the peripheral surface of the photoconductor 2K. The exposing device 3K is designed so that a black-color image of, for example, 1200 dpi can be produced on the recording medium. The black toner image forming unit further includes a developing device 4K disposed downstream of the exposing device 3K with respect to the rotational direction of the photoconductor 2K. The developing device 4K supplies black toner onto the surface of the photoconductor 2K to develop the latent image. A black toner image is thus formed on the surface of the photoconductor 2K.

After development of the latent image with the developing device 4K, the black toner image formed on the surface of the photoconductor 2K is transferred onto the recording medium 7 with the aid of a transfer device 5K. Here, the yellow, magenta, cyan, and black toner images formed on the respective photoconductors 2Y, 2M, 2C, and 2K are sequentially transferred onto the recording medium 7 to superimpose one on the other, thereby forming a full-color toner image on the recording medium 7. The full-color toner image on the recording medium 7 is thermally fixed by a fixing device 8. The residual black toner on the photoconductor 2K is removed by a brush-shaped cleaning device 6K.

Next, the charging device 1 (1K, 1C, 1M, 1Y) used in the image forming device shown in FIG. 3 will be described with reference to FIG. 4.

Figure 4:
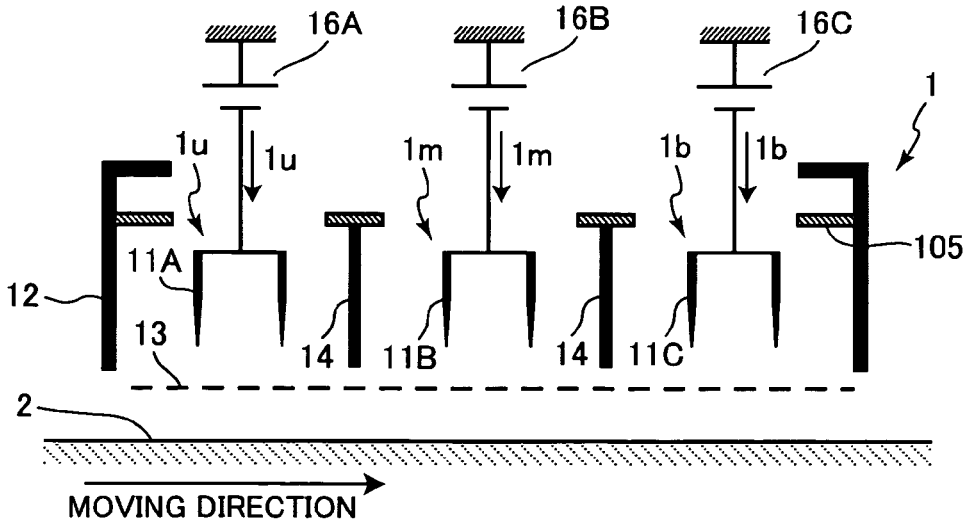
FIG. 4 is a schematic diagram showing a charging device in accordance with the first embodiment of the invention.

As shown in FIG. 4, the charging device 1 includes a shield case 12, electrically conductive partitioning plates 14, three pairs of electrode plates 11A, 11B and 11C (each pair will be designated by reference numeral "11" when distinction between three pairs is not necessary), and a grid 13. The shield case 12 houses the partitioning plates 14 and the electrode plates 11. The partitioning plates 14 partition the internal space of the shield case 12 into three parts in which three pairs of electrode plates 11A, 11B, and 11C are disposed respectively. The shield case 12 has one side formed with an opening. The opening faces the photoconductor 2 when the charging device 1 is set to a relevant position. The grid 13 is attached to the opening of the shield case 12 to be spaced apart a predetermined distance from the tip ends of the electrode plates 11.

Figure 6:
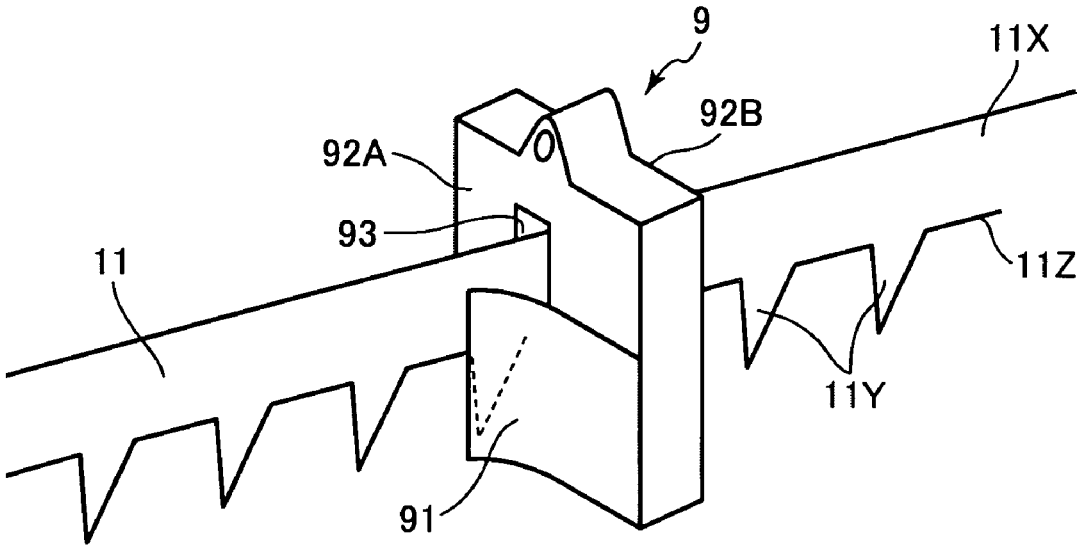
FIG. 6 is a schematic diagram illustrating how to clean a saw-tooth electrode.

As shown in FIG. 6, the electrode plate 11 is configured from an elongated base portion 11X and a plurality of saw-tooth shaped electrodes 11Y. The base portion 11X has an edge 11Z. The saw-tooth shaped electrodes 11Y are formed at equi-pitch on the edge 11Z. Referring back to FIG. 4, each pair of electrode plates 11 extends in parallel to an axial direction of the photoconductor 2, i.e., to the direction perpendicular to the sheet of drawing. Corona discharges occur between two confronting saw-tooth shaped electrodes in the paired electrode plates.

In this embodiment, the three pairs of electrode plates 11A, 11B, and 11C will be referred to as "first saw-tooth electrode section", "second saw-tooth electrode section", and "third saw-tooth electrode section", respectively. The first saw-tooth electrode section 11A is disposed at an upstream side 1*u* of the second saw-tooth electrode section 11B with respect to the moving direction of the photoconductor 2. The third saw-tooth electrode section 11C is disposed at a downstream side 1*b* of the second saw-tooth electrode section 11B. The second saw-tooth electrode section 11C is disposed at a center portion 1*m* between the upstream side 1*u* and the downstream side 1*b*. Current-controlled power sources 16A, 16B, and 16C are connected to the first, second, and third saw-tooth electrode sections 11A, 11B, and 11C to flow currents Iu, Im, Ib, respectively.

Specific dimensions of and positional relation between the components of the charging device 1 will next be described.

The outer electrode plate of the first saw-tooth electrode section 11A is positioned apart 8 mm from the inner sidewall of the shield case 12. Similarly, the outer electrode plate of the third saw-tooth electrode section 11C is positioned apart 8 mm from the inner sidewall of the shield case 12. Paired electrode plates are spaced apart 12 mm from each other. Each electrode plate is disposed so that the tip ends of the saw-tooth shaped electrodes are apart 9 mm from the surface of the photoconductor 2. The shield case 12 grid 13 is apart 1.5.

Each electrode plate has a length of 550 mm in the axial direction of the photoconductor 2, and a thickness of 0.1 mm. The saw-tooth shaped electrodes 11Y have a height of 20 mm and a tooth angle of 15 degrees.

The shield case 12 has a length of 600 mm in the axial direction of the photoconductor 2, and a width of 86 mm in the direction perpendicular to the lengthwise direction. The shield case 12 is disposed so that the grid 13 is apart 1.5 mm from the peripheral surface of the photoconductor 2. The grid 13 is configured from a plurality of grid wires each having a width of 0.1 mm in the widthwise direction of the shield case 12 and a thickness of 0.1 mm in the direction perpendicular to the widthwise direction of each grid wire. The wire-to-wire distance of the grid 13 is held at 1.3 mm.

The electrode plates 11 are formed from stainless (SUS303) and the stainless plate is etched to form the saw-tooth electrodes. The shield case 12 is connected to ground. The partitioning plates 14 are electrically connected to the shield case 12. Therefore, the partitioning plates 14 are also held at the ground potential. A voltage-controlled power source (not shown) is connected to the grid 13.

Generally, long time use of the image forming device generates black stripes in the tip end portions of the saw-tooth shaped electrodes. Generation of the black stripes results from adhesion of foreign materials, such as dusts, toner, or paper dusts floating in the air, onto the electrode surface. The present inventors conducted experiments to evaluate the black stripes appearing in the tip end portion of the saw-tooth shaped electrode while changing the current Im flowing in a unit length of the electrode plate 11B. It should be noted that the current flowing in the unit length of the electrode plate 11 (hereinafter referred to as "unitary current") refers to a current value calculated by dividing the current supplied from the corresponding power source with the longitudinal length (i.e., the length in the axial direction of the photoconductor 2) of the electrode plate 11. In this experiment, to change the unitary current Im, the unitary currents Iu and Ib flowing in the electrode plates 11A and 11C were changed while maintaining the total current flowing in the three pairs of electrode plates 11A, 11B, and 11C at a predetermined value. The predetermined value indicative of the total current is set so that the surface potential of the photoconductor 2 that has just passed by the charging device 1 is higher by 50 V in the negative direction than the voltage applied to the grid 13. The unitary currents Iu and Ib of the electrode plates 11A and 11C are set to be equal to each other. The experiments were conducted under a circumstance of room temperature and room humidity. The voltage applied to the grid 13 was −550 V. The black stripes appeared in the electrodes were evaluated by comparing them with reference fine line patterns (2ON4OFF).

Next, experimental results will be described.

<Experiment 1>

In order to provide a reference used as a basis for comparison, unitary current of 1.39 μA/mm is equally applied to the three pairs of the electrode plates 11A, 11B, and 11C which are set in the upstream side 1*u*, center portion 1*m*, and the downstream side 1*b*, respectively. As a result of experiment, generation of the black strips was recognized in the tip end portion of the saw-tooth electrode after about 35000 rotations of the photoconductor 2. Investigation of the black strips with an electronic microscope revealed that the materials forming the black strips are discolored foreign materials including dusts, toner, and paper dust as contained in the air. To generate corona discharges using the electrodes formed with the black stripes, a higher voltage needs to be applied to the electrodes than the normal voltage. Because, in the foreign material adhered condition, the corona discharges are unlikely to occur if the voltage applied to the electrode is maintained at the normal voltage. The voltage required for generating the corona discharge will hereinafter referred to as "corona discharge voltage". Measurements of the corona discharge voltage can therefore assume an amount of foreign materials adhered to the saw-tooth electrode. Actual measurements of the corona discharge voltage revealed that the corona discharge voltage was increased by 0.4 kV with respect to the electrode plate 11B disposed at the center portion 1*m*, and by 0.7 kV with respect to the electrode plates 11A and 11C disposed at the upstream side 1*u* and the downstream side 1*b*, respectively. The increased voltage is about 0.3 kV higher in the upstream and downstream side electrode plates 11A and 11C than the center electrode plate 11B.

<Experiment 2>

Unitary current of 2.93 μA/mm is applied to the center electrode plates 11B and unitary current of 0.63 μA/mm is applied to each of the upstream-side and downstream-side electrode plates 11A and 11C. That is, the unitary current set to flow in the center electrode plates 1B is 4.7 times as much as the unitary current set to flow in the upstream-side and downstream-side electrode plates 1A and 1C. In this condition, adhesion of the foreign materials to the tip end portion of the saw-tooth electrode 11 was recognized after about 20000 rotations of the photoconductor 2. The corona discharge voltage was increased in due course and was proceeded to a spark discharge.

<Experiment 3>

Unitary current Im for the electrode plates 11B disposed in the center portion was set to 1.3 to 3.0 times as much as unitary current Iu or Ib for the electrode plates 11A and 11C disposed in the upstream and downstream sides. Specifically, unitary current of 1.67 μA/mm was applied to the center electrode plates 11B and unitary current of 1.25 μA/mm was applied to the upstream-side and downstream-side electrode plates 11A and 11C. That is, the unitary current set to flow in the center electrode plates 1B is 1.3 times as much as the unitary current set to flow in the upstream-side and downstream-side electrode plates 1A and 1C. In this condition, adhesion of the foreign materials to the tip end portion of the saw-tooth electrodes 11 was not recognized until the photoconductor 2 was rotated about 40000 times.

<Experiment 4>

Unitary current of 2.09 μA/mm was applied to the center electrode plate 11B and unitary current of 1.05 μA/mm was applied to each of the upstream-side and downstream-side electrode plates 11A and 11C. That is, the unitary current set to flow in the center electrode plate 1B was 2.0 times as much as the unitary current set to flow in the upstream-side and downstream-side electrode plates 1A and 1C. Also, unitary current of 2.51 μA/mm was applied to the center electrode plate 11B and unitary current of 0.84 μA/mm was applied to each of the upstream-side and downstream-side electrode plates 11A and 11C. That is, the unitary current set to flow in the center electrode plate 1B was 3.0 times as much as the unitary current set to flow in the upstream-side and downstream-side electrode plates 1A and 1C. In both cases, adhesion of the foreign materials to the tip end portion of the saw-tooth electrodes 11 was not recognized until the photoconductor 2 was rotated about 55000 times.

The experiments described above has proven that generation of the black stripes can be delayed if the unitary current Im for the center electrode plates 11B is set to be 1.3 to 3.0 times as much as the unitary current Iu or Ib for the upstream-side or downstream-side electrode plates 11A or 11C when compared with the reference case described above in relation to Experiment 1. Specifically, with the condition described above, the black strips appeared after further 5000 to 20000 rotations of the photoconductor 2 from the generation of the black stripes according to the conditions set in the reference case. Accordingly, the cleaning frequency of the electrode plates 11 can be prolonged.

Further, in the above-described case where unitary current of 2.09 μA/mm was applied to the center electrode plates 11B and unitary current of 1.05 μA/mm was applied to each of the upstream-side and downstream-side electrode plates 11A and 11C, the corona discharge voltage measured when the photoconductor 2 made about 35000 rotations was increased by 0.5 kV with respect to each of the upstream-side, center, and downstream-side electrode plates 11A, 11B, and 11C. As described, by setting the unitary current for the center electrode plates 1B to be 2.0 times as much as the unitary current for the upstream-side and downstream-side electrode plates 1A and 1C, the amount of increase of the corona discharge voltage with respect to the three electrode plates can be lowered as compared with the amount of increase according to the conventional settings.

The experiments described above have further proven that the amount of foreign materials adhered to the saw-tooth electrodes can be decreased by reducing the unitary current Iu or Ib set to flow in the electrode plates 11A or 11C. Also, it is desirable that the levels of the unitary currents Iu and Ib for the electrode plates 11A and 11C be set to equal to each other.

Figure 5:
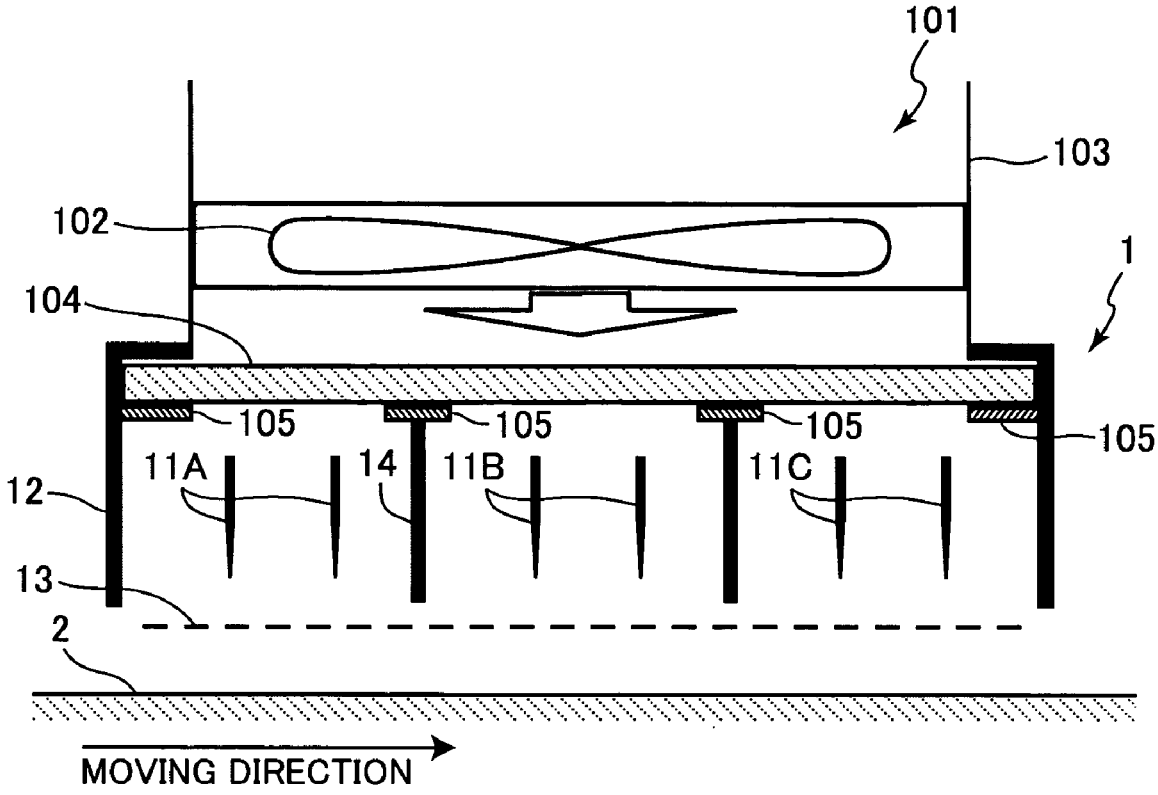
FIG. 5 is a schematic diagram showing a charging device in accordance with a second embodiment of the invention.

Next, a second embodiment of the invention will be described with reference to FIG. 5.

The charging device 1 according to the second embodiment includes a filter 104 and an air blower 101 in addition to the components making up the charging device according to the first embodiment. The filter 104 is provided for filtering foreign particles contained in the air. The air blower 101 is provided for blowing air into the internal space of the shield case 14 through the filter 104. The shield case 12 has a rear side opposite to the side where the grid 13 is attached. The rear side of the shield case 12 is formed with an opening. The filter 104 is attached to the inner portion of the shield case 12 to cover the opening. The opening occupies a major part of the rear side of the shield case 12 so that air is blown into the entire internal space of the shield case 14. To support the filter 104, support members 105 are secured to the side walls of the shield case 12 and the partitioning plates 14.

The air blower 101 includes a connector 103 and a fan 102. The air blower 101 is fixedly mounted on the shield case 12 in a position just above the filter 104 so that air blown from the air blower 101 is directed into the internal space of the shield case 12 through the filter 104. The connector 103 is a cylindrical shape and accommodates the fan 102 therein. The connector 103 extends upward, i.e., in the direction perpendicular to and apart from the peripheral surface of the photoconductor 2. The connector 103 fixedly supports the fan 102.

The filter 104 used in the second embodiment is an "Everlight Scott (HR-20)" manufactured by Bridgestone Corporation, which has such a dimension that the width is 86 mm, length is 600 mm, and thickness is 5 mm and has an average foreign material capturing efficiency of about 60%.

With the configuration described above, a great deal of dusts contained in the air can be captured by the filter 104 and therefore little dusts adhere onto the saw-tooth electrodes 11. The filter 104 is attached to the rear side of the shield case 12, therefore, it can easily be detached from the shield case 12. As such, maintenance of the filter 104 is facilitated.

The present inventors conducted experiments to evaluate the effects of filter 104. The experiments were conducted under the circumstance of room temperature and room humidity. The voltage applied to the grid 13 was −550 V. The unitary current for the electrode plate 11B disposed at the center portion 1*m* is set to 2.09 μA/mm and that for the electrode plates 11A and 11C disposed at both sides of the electrode plate 11B is set to 1.05 μA/mm. That is, the unitary current for the central electrode plate 11B is set to be 2.0 times as much as the unitary current for each of the upstream-side and downstream-side electrode plates 11A and 11C.

With the charging device 1 incorporating the filter 104 therein, black stripes appeared in the tip end portion of the saw-tooth electrode after about 65000 rotations of the photoconductor 2. Appearance of the black stripes was after further 10000 rotations of the photoconductor 2 from when the black stripes appeared with the charging device 1 in which filter 104 is not used.

FIG. 6 shows how to clean the electrode plate 11. To clean the same, a cleaning block 9 is used. The cleaning block 9 has two major surfaces 92A and 92B opposite to each other in which an elongated through-hole 93 is formed. The electrode plate 11 can be inserted into the through-hole 93 and moved relative to the cleaning block 9 or vice versa. A pair of sheet-like, resilient cleaning members 91 made from, for example, polyurethane is attached to the major surface 92A of the cleaning block 9 (only one cleaning member 91 is depicted in FIG. 6) in such a manner that the cleaning members 91 are partly adhered to the major surface 92A and the free end portions of the cleaning member 91 extend over the through-hole 93. By moving the cleaning block 9 relative to the electrode plate 11 or vice versa, the pair of cleaning members 91 slidably contacts and thus cleans both surfaces of the saw-tooth shaped electrodes formed in the electrode plate 11.

While the image forming device according to the present invention has been described in detail with reference to specific embodiments thereof, it would be apparent to those skilled in the art that many modifications and variations may be made therein without departing from the spirit of the invention, the scope of which is defined by the attached claims. For example, the configuration of the above-described embodiment was such that yellow (Y), magenta (M), cyan (C), and black (K) toner image forming units are disposed in the stated order in a direction in which the recording medium is transported. However, the order in which the respective image forming units are arranged is not limited to that described above.

Further, the configuration of the above-described embodiment was such that each electrode plate is formed with a plurality of saw-tooth shaped electrodes. Although arrangement of a plurality of saw-tooth shaped electrodes over the entire width of the photoconductor is desirable in terms of forming a uniform electric field in the photoconductor, the number of saw-tooth shaped electrodes may be reduced to one.

Figure 7:
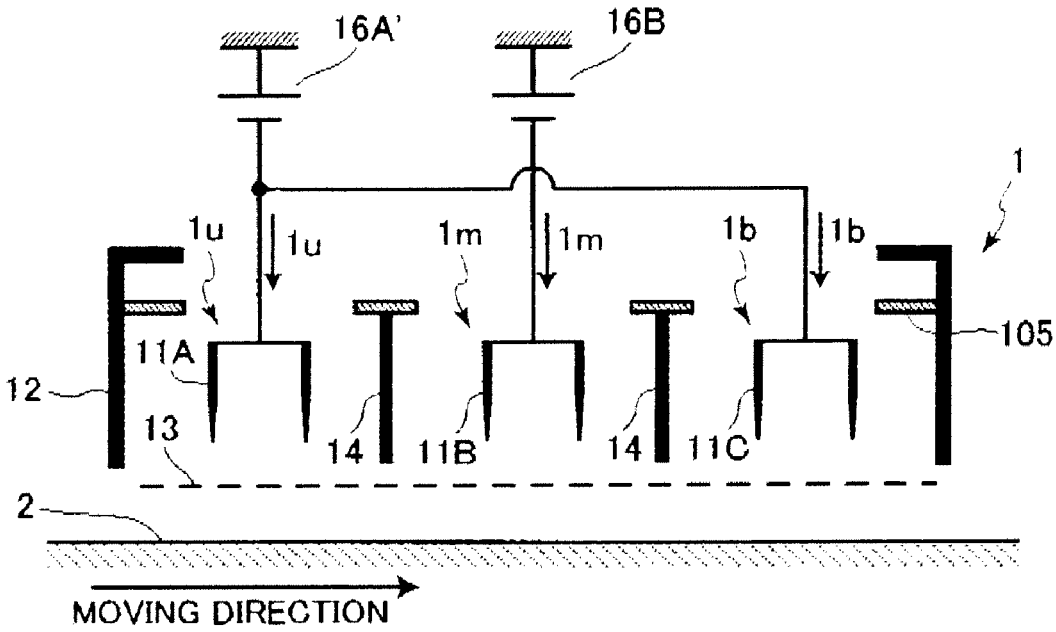
FIG. 7 is a schematic diagram showing a variation of the FIG. 4 charging device according to the invention.

Further, in the first embodiment described above, separate power sources 16A, 16B, and 16C are provided for the electrode plates 11A, 11B, and 11C, respectively. However, referring to the FIG. 7 example, the number of the power sources may be reduced to two, one such as 16A' connecting to the upstream-side and downstream-side electrode plates 11A and 11C, and the other, such as 16B of FIG. 4 connected to the center electrode plate 11B. In this case, the two power sources 16A' and 16B may be designed so that the power source 16B for the center electrode plate 11B supplies unitary current lm that is 1.3 to 3.0 times as much as the unitary current lu or lb supplied from another (e.g., 16A') power source to the upstream-side and downstream-side electrode plates 11A and 11B.

In the second embodiment of the invention, "Everlight Scott" was used for the filter 104, but filters, such as "Saranlock Filter", glass fiber filter, can be used instead. Further, the filter 104 may contain active carbon particles to have a capability of absorbing ozone. In this case, it is desirable to create an airflow flowing from interior to the exterior of the shield case 12.

What is claimed is:

1. A charging device for charging a photoconductor, wherein the photoconductor is rotatable about an axis and has a surface to be charged, the surface having a width a extending in an axial direction of the photoconductor, the charging device comprising:

a first saw-tooth electrode section including a pair of electrode plates each formed with at least one saw-tooth shaped electrode that generates corona discharges for charging the charging the photoconductor, each of the pair of electrode plates in the first saw-tooth electrode section having a length;

a second saw-tooth electrode section including a pair of electrode plates each formed with at least one saw-tooth shaped electrode that generates corona discharges for charging the charging the photoconductor, each of the pair of electrode plates in the second saw-tooth electrode section having a length;

a third saw-tooth electrode section including a pair of electrode plates each formed with at least one saw-tooth shaped electrode that generates corona discharges for charging the charging the photoconductor, each of the pair of electrode plates in the third saw-tooth electrode section having a length; and a current source connected to said first, second, and third electrode sections, wherein the first, second, and third saw-tooth electrode sections are disposed along the surface of the photoconductor in such a manner that the first saw-tooth electrode section is disposed at an upstream side of the second saw-tooth electrode section with respect to a direction in which the photoconductor rotates, the third saw-tooth electrode section is disposed at a downstream side of the second saw-tooth electrode section with respect to the direction in which the photoconductor rotates, and the second saw-tooth electrode section is interposed between the first saw-tooth electrode section and the third saw-tooth electrode section, and wherein said current source is arranged to provide a current flow in a unit length of each of the pair of electrode plates in the first and third saw-tooth electrode sections is ⅓ to 1/1.3 times as much as a current flow in a unit length of each of the pair of electrode plates in the second saw-tooth electrode section.

2. The charging device according to claim 1, wherein said current source provides a current flow in the unit length of each of the pair of electrode plates in the first saw-tooth electrode section that is equal to the current flow in the unit length of each of the pair of electrode plates in the third saw tooth electrode section.

3. The charging device according to claim 2, wherein said current source comprises:

a first power source connected to the first saw-tooth electrode section to supply current to the pair of electrode plates in the first saw-tooth electrode section;

a second power source connected to the second saw-tooth electrode section to supply current to the pair of electrode plates in the second saw-tooth electrode section; and a third power source connected to the third saw-tooth electrode section to supply current to the pair of electrode plates in the third saw-tooth electrode section.

4. The charging device according to claim 2, wherein said current source comprises:

a first power source connected to both the first and third saw-tooth electrode sections to supply current to the pair of electrode plates in the first and third saw-tooth electrode sections; and a second power source connected o the second saw-tooth electrode section to supply current to the pair of electrode plates in the second saw-tooth electrode section.

5. The charging device according to claim 1, wherein each of the pair of electrode plates in each of the first, second, and third saw-tooth electrode sections comprises an elongated base portion having an edge extending in a longitudinal direction of the elongated base portion, and a plurality of saw-tooth shaped electrodes formed on the edge of the elongated base portion, and wherein the pair of electrode plates in each of the first, second, and third saw-tooth electrode sections are arranged so that the plurality of saw-tooth shaped electrodes in one of the pair of electrode plates are parallel with the plurality of saw-tooth shaped electrodes in another one of the pair of electrode plates.

6. The charging device according to claim 1, wherein the pair of electrode plates in each of the first, second, and third saw-tooth electrode sections is arranged so that the plurality of saw-tooth shaped electrodes in one of the pair of electrode plates is arranged in the widthwise direction of the photoconductor.

7. The charging device according to claim 1, further comprising a filter that prevents foreign materials contained in air from entering into a space where each of the first, second, and third saw-tooth electrode sections is disposed.

8. The charging device according to claim 7, further comprising an air blower that blows air toward the space through the filter.

9. An image forming device comprising:

photoconductor that is rotatable about an axis and has a surface to be charged, the surface having a width a extending in an axial direction of the photoconductor;

a charging device comprising:

a first saw-tooth electrode section including a pair of electrode plates each formed with at least one saw-tooth shaped electrode that generates corona discharges for charging the charging the photoconductor, each of the pair of electrode plates in the first saw-tooth electrode section having a length;

a second saw-tooth electrode section including a pair of electrode plates each formed with at least one saw-tooth shaped electrode that generates corona discharges for charging the charging the photoconductor, each of the pair of electrode plates in the second saw-tooth electrode section having a length; and a third saw-tooth electrode section including a pair of electrode plates each formed with at least one saw-tooth shaped electrode that generates corona discharges for charging the charging the photoconductor, each of the pair of electrode plates in the third saw-tooth electrode section having a length, and a current source connected to said first, second, and third electrode sections, wherein the first, second, and third saw-tooth electrode sections are disposed along the surface of the photoconductor in such a manner that the first saw-tooth electrode section is disposed at an upstream side of the second saw-tooth electrode section with respect to a direction in which the photoconductor rotates, the third saw-tooth electrode section is disposed at a downstream side of the second saw-tooth electrode section with respect to the direction in which the photoconductor rotates, and the second saw-tooth electrode section is interposed between the first saw-tooth electrode section and the third saw-tooth electrode section, and wherein said current source is arranged to provide a current flow in a unit length of each of the pair of electrode plates in the first and third saw-tooth electrode section is ⅓ to 1/1.3 times as much as a current flow in a unit length of each of the pair of electrode plates in the second saw-tooth electrode sections;

an exposing device that exposes the photoconductor to light in accordance with image data to form a latent image on the surface of the photoconductor;

developing device that develops the latent image and forms a visible toner image on the photoconductor; and a transfer device that transfers the visible toner image onto a recording medium.

10. The image forming device according to claim 9, wherein the current set to flow in the unit length of each of the pair of electrode plates in the first saw-tooth electrode section is equal to the current set to flow in the unit length of each of the pair of electrode plates in the third saw tooth electrode section.

11. The image forming device according to claim 10, further comprising:

a first power source connected to the first saw-tooth electrode section to supply current to the pair of electrode plates in the first saw-tooth electrode section;

a second power source connected to the second saw-tooth electrode section to supply current to the pair of electrode plates in the second saw-tooth electrode section; and a third power source connected to the third saw-tooth electrode section to supply current to the pair of electrode plates in the third saw-tooth electrode section.

12. The image forming device according to claim 10, further comprising:

a first power source connected to both the first and third saw-tooth electrode sections to supply current to the pair of electrode plates in the first and third saw-tooth electrode sections; and a second power source connected to the second saw-tooth electrode section to supply current to the pair of electrode plates in the second saw-tooth electrode section.

13. The image forming device according to claim 9, wherein each of the pair of electrode plates in each of the first, second, and third saw-tooth electrode sections comprises an elongated base portion having an edge extending in a longitudinal direction of the elongated base portion, and a plurality of saw-tooth shaped electrodes formed on the edge of the elongated base portion, and wherein the pair of electrode plates in each of the first, second, and third saw-tooth electrode sections are arranged so that the plurality of saw-tooth shaped electrodes in one of the pair of electrode plates are parallel with the plurality of saw-tooth shaped electrodes in another one of the pair of electrode plates.

14. The image forming device according to claim 9, wherein the pair of electrode plates in each of the first, second, and third saw-tooth electrode sections is arranged so that the plurality of saw-tooth shaped electrodes in one of the pair of electrode plates is arranged in the widthwise direction of the photoconductor.

15. The image forming device according to claim 9, further comprising a filter that prevents foreign materials contained in air from entering into a space where each of the first., second, and third saw-tooth electrode sections is disposed.

16. The image forming device according to claim 15, further comprising an air blower that blows air toward the space through the filter.

17. A method for reducing debris accumulation on saw-tooth electrodes for charging photoconductor rotatable in a direction about an axis and having a surface to be charged, the surface having a width a extending in an axial direction of the photoconductor, comprising:

arranging a first saw-tooth electrode plate pair having a length, a second saw-tooth electrode plate pair having a length, and a third saw-tooth electrode plate pair having a length, wherein the arranging locates the first saw-tooth electrode plate pair upstream of the second saw-tooth electrode plate pair, with respect to the direction in which the photoconductor rotates, and locates the third saw-tooth electrode plate pair downstream of the second saw-tooth electrode plate pair, with respect to the direction in which the photoconductor rotates; and generating a corona for charging the photoconductor by passing a first current through the first saw-tooth electrode plate pair, a second current through the first saw-tooth electrode plate pair and a third current through the third saw-tooth electrode plate pair, wherein the first current through a unit length of the first saw-tooth electrode plate pair is ⅓ to 1/1.3 times the second current through a unit length of the second saw-tooth electrode plate pair, and the third current through a unit length of the third saw-tooth electrode plate pair is ⅓ to 1/1.3 times the second current through a unit length of the second saw-tooth electrode plate pair.

* * * * *